US006026521A

United States Patent [19]

Atkins

[11] Patent Number: 6,026,521

[45] Date of Patent: Feb. 22, 2000

[54] TWO-PIECE WATER CLOSET RING

[76] Inventor: Gary B. Atkins, 2757 Grassmere, Shreveport, La. 71108

[21] Appl. No.: 09/199,077

[22] Filed: Nov. 23, 1998

[51] Int. Cl.[7] ..... E03D 11/16

[52] U.S. Cl. ..... 4/252.4; 4/252.1; 285/56; 285/415; 285/15

[58] Field of Search ..... 4/252.1, 252.4, 4/252.5, 252.6, 419, 661; 285/15, 16, 17, 56–60, 415

[56] References Cited

U.S. PATENT DOCUMENTS

| | | | |
|---|---|---|---|
| 1,784,667 | 12/1930 | Gillet | 285/415 |
| 2,764,431 | 9/1956 | Wilde | 285/415 |
| 2,911,239 | 11/1959 | Marzolf | 285/415 |
| 3,319,268 | 5/1967 | Blumenkranz | 4/252 |
| 3,415,547 | 12/1968 | Yano | 285/337 |
| 3,524,662 | 8/1970 | Tolman et al. | 285/368 |
| 4,207,630 | 6/1980 | Bressler | 4/252 R |
| 4,519,639 | 5/1985 | Florian | 285/415 |
| 4,660,266 | 4/1987 | Horn | 29/417 |
| 5,220,694 | 6/1993 | Knorovsky | 4/252.1 |
| 5,314,215 | 5/1994 | Weinhold | 285/283 |
| 5,492,372 | 2/1996 | Dranberg | 4/252.4 |
| 5,890,239 | 4/1999 | Hite | 4/252.5 |

*Primary Examiner*—Henry J. Recla
*Assistant Examiner*—Tuan Nguyen
*Attorney, Agent, or Firm*—John M. Harrison

[57] ABSTRACT

A two-piece water closet ring for receiving a water closet drain fitting extending upwardly through a floor and anchoring a water closet to the floor in fluid communication with the drain fitting. In a preferred embodiment the two-piece water closet ring has substantially coplanar bottom flange surfaces when assembled and is characterized by substantially semicircular first and second bottom flanged ring segments, each end of each ring segment terminating in a slotted flange. The channel-shaped ring segments are fitted around the extending end of the drain fitting to form a circular water closet ring, with the raised slotted flange on one end of each ring segment overlying the straight slotted flange on the corresponding end of the other ring segment. Ring mount screws secure the ring segments to the floor and against the water closet drain fitting. Water closet mount bolts are extended upwardly through each pair of registering slots, through or adjacent to a wax gasket and through openings in the base of the water closet as the water closet is seated on the wax gasket.

11 Claims, 2 Drawing Sheets

TWO-PIECE WATER CLOSET RING

BACKGROUND OF THE INVENTION

1. Field of the Invention

This invention relates to water closet rings for securing a commode or water closet on a floor and more particularly, to a two-piece, channel-shaped water closet ring having a pair of generally semicircular first and second bottom flange ring segments, one end of each ring segment terminating in a raised flange and the other end of each ring segment terminating in a straight flange, each raised and straight flange having a slotted opening provided therein. One of the ring segments is first fitted in a slot around one side of a conventional water closet drain fitting extending upwardly through a floor from a floor drain pipe. The opposite ring segment is then fitted around the slotted opposite side of the water closet drain fitting, with the raised slotted flange on one end of the first ring segment overlying the straight slotted flange on the corresponding end of the second ring segment, and the straight slotted flange on the opposite end of the first ring segment underlying the raised slotted flange on the corresponding end of the second ring segment. The channel-shaped ring segments define substantially coplanar, parallel bottom flange ring surfaces and multiple ring mount openings are included in each ring segment between the slotted openings for receiving respective ring mount screws, which are threaded into the floor or into screw anchors to removably secure the ring segments to the floor with the coplanar channel-shaped flange surfaces resting securely on the floor. A water closet mount bolt is then extended upwardly through each pair of registering slotted openings. A donut-shaped wax gasket is placed on the assembled and mounted circular water closet ring and a water closet is seated on top of the wax gasket with the water closet mount bolts projecting through openings in the water closet base. After the water closet is properly positioned on the wax gasket, a nut is threaded on the end of each water closet mount bolt and tightened against a washer resting on the base of the water closet to compress and seal the wax gasket between the base of the water closet and the water closet ring. The first ring segment or second ring segment, or both, of the water closet ring can be easily replaced without having to remove the closet drain fitting from the floor drain pipe. This replacement is effected by first unthreading and removing the nuts and washers from the respective water closet mount bolts, lifting the water closet and wax gasket from the assembled water closet ring, removing the ring mount screws which secure the ring segment or segments to the floor and then removing the damaged ring segment or segments and securing a replacement ring segment or segments in its place, as described above.

In residential and commercial buildings, sewerage pipes which drain water closets seated on a restroom floor typically originate a short distance above and extend downwardly below the surface of the floor. A typical conventional water closet ring includes a circular, stamped metal flange which is secured to the flanged upper end of a closet drain fitting that engages the sewerage floor drain pipe. A wax sealing ring or gasket is positioned on the water closet ring and the base of the water closet is positioned on the wax gasket. Bolts extend upwardly through preformed bolt slots provided in the metal flange of the water closet ring and through the wax gasket and openings in the base of the water closet. Retaining nuts are then threaded on each bolt shank, thus compressing the wax gasket to form a liquid-tight connection between the sewerage drain pipe and the water closet.

One of the problems associated with conventional water closet rings is that the typically stamped steel ring corrodes and rusts over a period of time and a portion of the ring frequently breaks off from the remainder of the ring, such that the base of the water closet is no longer seated firmly on the wax gasket provided between the base of the water closet and the water closet ring. This causes unsteadiness of the water closet and also may result in water leaking from the base of the water closet. Replacement of rusted, corroded or broken water closet rings is difficult, since the conventional rings are designed to form a permanent part of the closet drain fitting in the plumbing installation and cannot be easily removed from the sewer line to which they are attached without removing the water closet from the water closet ring and sewer drain pipe and replacing the entire water closet ring and closet drain fitting assembly. This replacement usually involves chiseling the existing assembly from the floor with the expenditure of much time and effort.

2. Description of the Prior Art

Various flanges and water closet rings are known in the art for sealing pipe connections or sealing a water closet on a sewer drain pipe. U.S. Pat. No. 3,415,547, dated Dec. 10, 1968, to Shinkichi Yano, describes an "Annular Locking Assembly Used In Ring Attachments For Preventing Water Leakage In Water Pipe Connections". The locking assembly is characterized by a clamping ring having two arcuate sections, each provided on one end with a first stud disposed parallel to the axis of the pipes being connected. A retaining aperture is provided on the other end of each section, through which aperture the first stud of the other section can be passed upon flexing the sections such that their planes cross each other. A second ring includes two arcuate sections having apertures to receive all the studs of the assembled first ring. U.S. Pat. No. 3,524,662, dated Aug. 18, 1970, to Edgar B. Tolman, et al, discloses a "Coupling For Hard Cast Iron Pipe" for joining two links of pipe constructed of cast iron, tile, porcelain or glass. Circumferential grooves are provided on the adjacent ends of each of the pipes to be connected. A pair of split rings which are round in cross-section are seated in the grooves and a bolting collar embraces each ring, each collar having a conical ring-contacting inner surface which is larger in circumference than the rings at a face of the collar near the adjacent pipe ends and smaller than the rings but larger than the pipe at a face of the collar remote from the corresponding pipe end. A compressible gasket is positioned between the adjacent ends of the pipes and bolts loosely extend through aligned holes in the collars and cooperate with nuts to draw the collars toward one another. A "Method of Repairing Water Closet Anchoring to Fractured Closet Flange and Spanner Clamp Therefore" is detailed in U.S. Pat. No. 4,207,630, dated Jun. 17, 1980, to Mark Bressler. The method includes the steps of disconnecting and disassembling a water closet from a water closet flange and assembling an arcuate, slotted repair spanner clamp on the bottom surface of the closet flange spanning the fracture therein. A further step includes extending a headed fastener up through the anchor clamp and reassembling the water closet on the anchor clamp. U.S. Pat. No. 4,519,639, dated May 28, 1985, to Roy S. Florian, describes a "Hinged Flange For Tailpipes and the Like" for coupling flanged pipes of an exhaust system. The hinged flange includes a pair of laminated clamp members of arcuate configuration, each including at least three arcuate sheet metal segments which are staggered in overlying relationship so as to provide end portions in which laminae are spaced apart. The end portions of the two clamp members are interfitted and are provided with aligned apertures, through which fasteners extend for assembly of the two clamp members with an associated clamping element, to clamp the flanged pipes together. U.S. Pat. No. 4,660,266, dated Apr. 28, 1987, to Joachim Horn, details a "Split-Flange Connector and Method of Making Same", including the step of rolling a strand of steel into an elongated bar having a rolled planar face formed centrally with a semi-cylindrical groove extending parallel to the face. The bar is then cut perpendicularly to the face into at least two identical sections of a predetermined length and at least one bore offset from and parallel to the groove is drilled through each bar section. U.S. Pat. No. 5,220,694, dated Jun. 22, 1993, to Alex Knorovsky, describes an "Anchoring Device and Method for Anchoring a Toilet to a Broken Water Closet Ring". The anchoring device is characterized by a circular flange having a missing portion which defines a gap in the flange. The anchoring device includes a pair of arcuate members, both having flat surfaces formed at the same diameter as the flange of the water closet ring. At least one of the members is formed over an arc of a length greater than a semicircle. The members are hingedly joined together at one end and each includes an apertured end which can be moved into overlapping relationship with respect to the apertured end of the other. The apertured ends are first drawn apart so that they may be positioned around the water closet ring and then brought together in overlapping relationship so that the members form a collar about the water closet ring. A sealing bolt is extended upwardly through the registering apertures and threaded into the base of the toilet for seating the toilet on the anchoring device. U.S. Pat. No. 5,314,215, dated May 24, 1994, to Karl Weinhold, details a "Flange Ring" which is divided into a pair of half flanges along a plane extending axially through the flange ring. Each half flange has a bolt in one end and a pocket in the other end, such that the bolt on one half flange may reversibly engage the pocket of the other half flange. The flange ring is formed with holes in both half flanges for the passage of fastening screws. U.S. Pat. No. 5,492,372, to Dranberg details a flat plate split replacement flange connected between the respective T-slots by screws or pins.

It is an object of this invention to provide a new and improved, two-piece water closet ring for seating a water closet on a floor in fluid communication with a water closet drain fitting extending above the floor, which water closet ring connects at respective T-slots and may be easily replaced without having to remove the water closet drain fitting from the floor drain.

Another object of this invention is to provide a two-piece, channel-shaped water closet ring having substantially parallel coplanar bottom flange surfaces and characterized by a substantially semicircular first bottom flanged ring segment terminated by slotted flanges on each end and a similar, complementary second bottom flanged ring segment also terminated by slotted flanges, which first ring segment or second ring segment may be individually unbolted, removed from the floor and from the opposite ring segment and replaced due to rusting, corrosion or breaking of the ring segment, without having to remove and replace the water closet drain fitting.

Still another object of this invention is to provide a two-piece, stamped, channel-shaped metal water closet ring characterized by a semicircular first parallel bottom flange ring segment having a raised slotted flange on one end and a straight slotted flange on the other end, which first ring segment engages a slot in the flanged upper end of a vertical water closet drain fitting extending downwardly through the floor against a floor drain pipe. The two-piece water closet ring is completed by a similar second parallel bottom ring flange ring segment, the ends of which are terminated by like slotted flanges, the raised slotted flange on one end of the first ring segment overlying the straight slotted flange on the corresponding end of the second ring segment, and the straight slotted flange on the opposite end of the first ring segment underlying the raised slotted flange on the corresponding end of the second ring segment. The ring segments of the completed, channel-shaped annular ring having substantially coplanar bottom flange surfaces, are secured to the floor and a water closet mount bolt is extended upwardly through each set of registering slots and through or adjacent to a wax ring or gasket and subsequently through the base of a water closet resting on the wax gasket, to receive a nut and washer and anchor the water closet on the floor in fluid communication with the sewer drain pipe in the floor.

SUMMARY OF THE INVENTION

These and other objects of the invention are provided in a two-piece, stamped steel water closet ring characterized by a substantially semicircular first generally channel-shaped ring segment which is terminated on one end by a raised slotted flange and on the other end by a straight slotted flange, and including a similar, complementary second generally channel-shaped ring segment, the ends of which are terminated by like slotted flanges. The first ring segment engages one arcuate side of the flanged upper end of a water closet drain fitting extending a short distance above a floor and communicating with a floor drain pipe. The second ring segment engages the other side of the sewer drain fitting to complete the annular water closet ring, with the straight slotted flange on one end of the first ring segment underlying the raised slotted flange on the corresponding end of the second ring segment and the raised slotted flange on the opposite end of the first ring segment overlying the straight slotted flange on the corresponding end of the second ring segment, wherein the curved, parallel bottom surfaces of the respective channel flanges are substantially coplanar. The two-piece water closet ring is secured to the floor structure with the bottom surfaces of the channel flanges stabilized on the floor, by means of screws and a water closet mount bolt is extended upwardly through each pair of registering slotted flanges. A wax ring or gasket is placed on the assembled and mounted water closet ring and the water closet mount bolts are subsequently extended through openings in the base of the water closet. The water closet is thusly securely, yet removably, seated on the wax gasket and the water closet mount bolts each receives a nut and a washer to secure the water closet on the floor in fluid communication with the water closet drain fitting and the floor drain pipe. Each channel-shaped ring segment can then be individually replaced without having to remove the water closet drain fitting, by unthreading the nuts from the water closet mount bolts, lifting the water closet and underlying wax gasket clear of the water closet mount bolts, removing the ring mount screws from the floor, and then removing and replacing the corresponding damaged ring segment or segments and remounting the water closet.

BRIEF DESCRIPTION OF THE DRAWINGS

The invention will be better understood by reference to the accompanying drawing, wherein.

DESCRIPTION OF THE PREFERRED EMBODIMENTS

Figure 1:
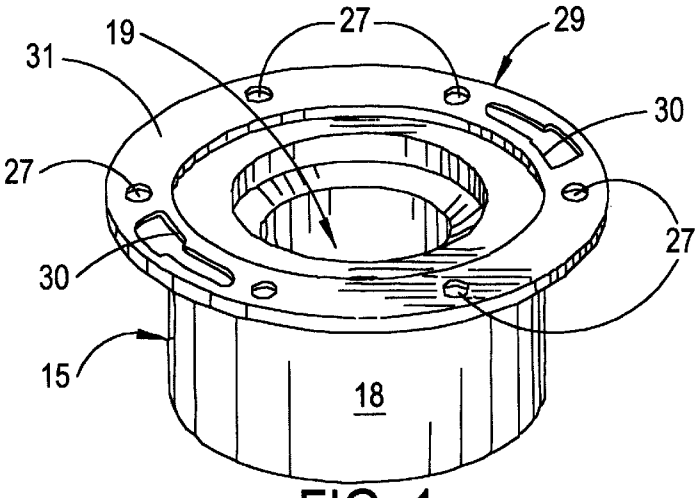
FIG. 1 Prior Art
FIG. 1 is a perspective view of a conventional water closet ring mounted on the flanged upper end of a water closet drain fitting.
Figure 5:
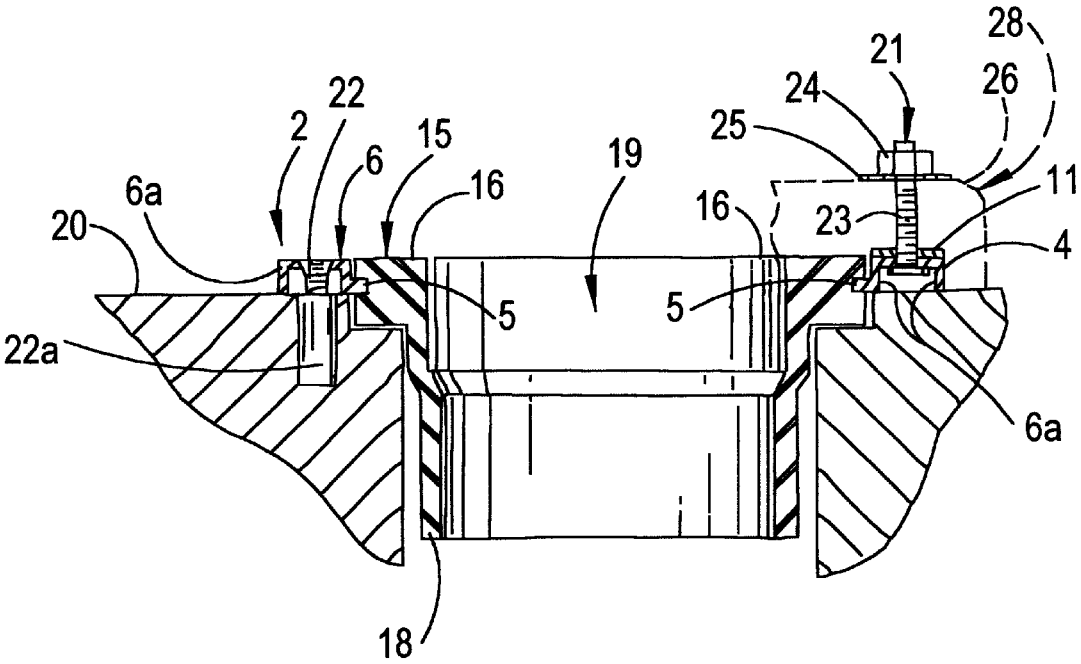
FIG. 5 is a sectional view of the two-piece water closet ring of this invention, removably mounted on a floor and encircling the flanged and slotted upper end of a water closet drain fitting extending through the floor.

Referring initially to FIG. 1 of the drawing, a conventional water closet ring is generally illustrated by reference numeral 29 and is used to seat the water closet base 26 of a commode, toilet or water closet 28 (illustrated in phantom in FIG. 5), on a floor 20 (FIG. 5). The water closet ring 29 engages a water closet drain fitting 15, having a drain pipe extension 18, which protrudes downwardly to meet a floor drain pipe (not illustrated). The conventional water closet ring 29 is characterized by a continuous, circular, stamped metal ring segment 31 having a pair of diametrically-opposed T-slots 30. The inside edge of the ring segment 31 seats in a drain pipe flange groove 17 (illustrated in FIG. 3), shaped in a drain fitting flange 16, which is formed on the upper end of the drain pipe extension 18, to define a complete closet ring-drain fitting assembly. Multiple mount openings 27, provided in the ring segment 31 between the T-slots 30, receive respective ring mount screws 22 (FIG. 5) which are subsequently threaded into the floor 20 or into screw anchors (not illustrated) mounted in the floor 20, to secure the ring segment 31 on the floor 20. After the conventional water closet ring 29 and water closet drain fitting 15 assembly is mounted and secured in place on the floor 20, with the water closet drain fitting 15 mounted in fluid communication with the underlying drain pipe, a flat-headed water closet mount bolt 21 (illustrated in FIG. 5), having a threaded shank 23 is extended upwardly through each T-slot 30. The closet mount bolts 21 are extended through a conventional wax ring or gasket (not illustrated) as the wax ring or gasket is lowered in place on the water closet ring 29, and are subsequently extended through an opening (not illustrated) in the water closet base 26. After the water closet 28 is lowered in position on the wax ring, each threaded shank 23 of the water closet mount bolts 21 then receives a washer 25 and a nut 24 is threaded on each threaded shank 23 and tightened against the washer 25 and the water closet base 26 to compress the wax gasket between the ring segment 31 and water closet base 26 and form a liquid-tight connection between the water closet 28 and the water closet drain fitting 15. Because the water closet ring 29 is permanently fitted on the drain fitting flange 16 of the water closet drain fitting 15, replacement of the conventional water closet ring 29 also requires removal and replacement of the closet drain fitting 15.

Figure 3:
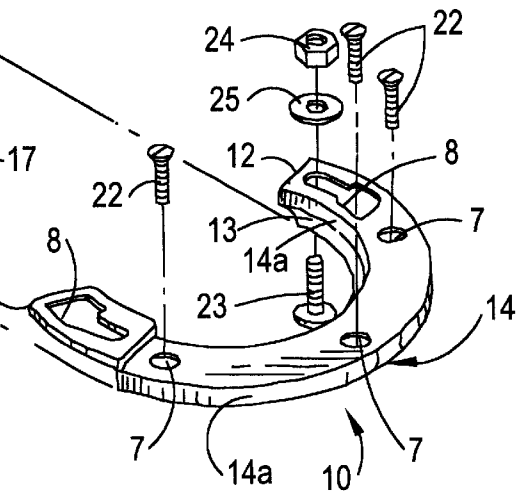
FIG. 3 is an exploded, perspective view of another embodiment of the two-piece water closet ring, illustrating a preferred technique for removably mounting the two-piece water closet ring on the flanged and slotted upper end of a water closet drain fitting extending through the floor.
Figure 3:
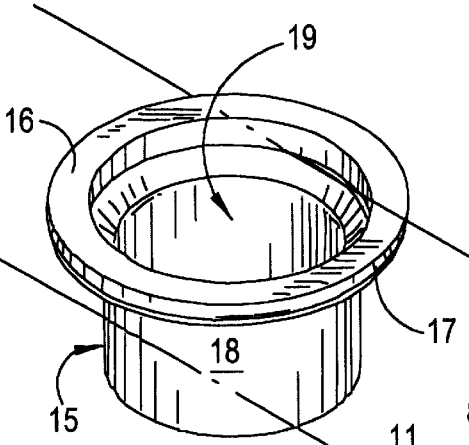

Referring now to FIGS. 2–5 of the drawing, in a preferred embodiment the two-piece water closet ring of this invention is generally illustrated by reference numeral 1 and includes a generally semicircular, channel-shaped, stamped metal, first ring segment 2, one end of which terminates in a first segment raised flange 3, extending in offset relationship from a first segment body 6, having downwardly-extending, parallel first segment body flanges 6*a*, and provided with a T-slot 8 therein, as illustrated in FIG. 3. A first segment straight flange 4, shaped in the opposite end of the first segment body 6 in substantially coplanar relationship to the first segment body 6, includes a semicircular first segment mount flange 5 which is formed in the inner curvature of the first segment body 6 and terminates at the junction of the first segment body 6 and first segment top flange 3. Multiple ring mount openings 7 are provided in the first segment body 6 between the first segment raised flange 3 and first segment straight flange 4, in spaced relationship with respect to each other.

Figure 2:
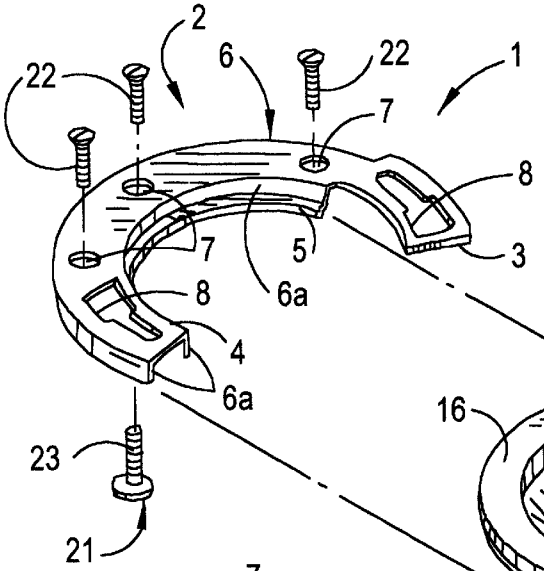
FIG. 2 is a top view of a first or second ring segment of a preferred embodiment of the two-piece water closet ring of this invention.
Figure 2:
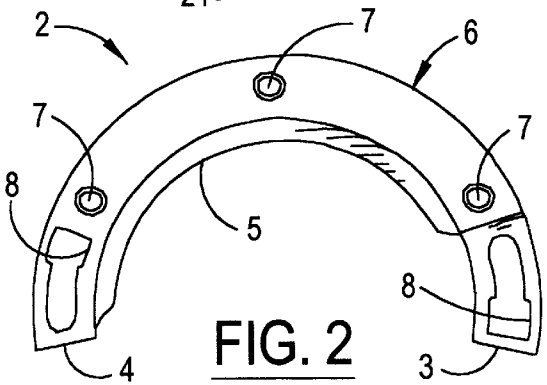

As illustrated in FIG. 3, the two-piece water closet ring 1 also includes a similar semicircular, channel-shaped second ring segment 10, one end of which is terminated by a second segment raised flange 11, extending in offset relationship from a second segment body 14, having parallel second segment body flanges 14*a* and provided with a T-slot 8 therein. The other end of the second ring segment 10 is terminated by a second segment straight flange 12, oriented in substantially coplanar relationship with respect to the second segment body 14 and having a T-slot 8 therein. A semicircular second segment mount flange 13 is formed in the inner curvature of the second segment body 14 of the second ring segment 10, terminating at the junction of the second segment body 14 with the second segment raised flange 11. Multiple ring mount openings 7 are provided in the second segment body 14 of the second ring segment 10, between the second segment raised flange 11 and second segment straight flange 12. As illustrated in FIG. 2, it will be appreciated that the first segment raised flange 3 and first segment straight flange 4 of the first ring segment 2, as illustrated, or second segment raised flange 11 and second segment straight flange 12 of the second ring segment 10 may be located on either opposite ends of the first ring segment 2 or the second ring segment 10, respectively, as long as the positions of the first segment raised flange 3 and first segment straight flange 4 on the respective ends of the first ring segment 2 correspond to the locations of the second segment straight flange 12 and second segment raised flange 11, respectively, on the second ring segment 10.

Figure 4:
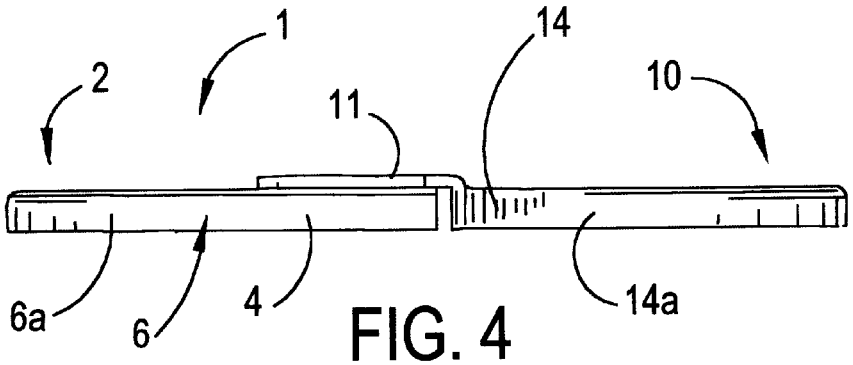
FIG. 4 is a planar view of the assembled two-piece water closet ring.

Referring now to FIGS. 3, 4 and 5 of the drawing, in a typical application, the first ring segment 2 of the two-piece water closet ring 1 is first fitted around the drain fitting flange 16, formed in the upper end of the drain pipe extension 18 of the closet drain fitting 15 and the first segment mount flange 5 is inserted in the annular drain pipe flange groove 17, which is shaped circumferentially in the drain fitting flange 16, as illustrated in FIGS. 3 and 5. The second ring segment 10 then receives the remaining arc of the drain fitting flange 16 and as the second segment mount flange 13 of the second ring segment 10 is inserted in the remaining curvature of the drain pipe flange groove 17, the second segment straight flange 12 is positioned in underlying, stacked relationship with respect to the corresponding, first segment raised flange 3 of the first ring segment 2, and the second segment raised flange 11 is positioned in overlying, stacked relationship with respect to the first segment straight flange 4. The second segment mount flange 13 of the second ring segment 10 is then in substantially coplanar relationship with respect to the first segment mount flange 5 of the first ring segment 2 and each T-slot 8 is positioned in registry with the corresponding, aligned T-slot 8. Moreover, the first segment body flanges 6*a* are coplanar with the aligned second segment body flanges 14*a* and thus rest securely on the floor 20. Ring mount screws 22 are then extended through the respective ring mount openings 7 provided in the first segment body 6 of the first ring segment 2 and second segment body 14 of the second ring segment 10, and threaded into the floor 20 or alternatively, into screw anchors 22*a*, provided in the floor 20, as illustrated in FIG. 5, to mount the assembled two-piece water closet ring 1 on the floor 20. The flat head of an inverted water closet mount bolt 21 is then inserted downwardly through the aligned enlarged portions of the corresponding pair of aligned T-slots 8, and the threaded shank 23 of each water closet mount bolt 21 is slipped into the aligned narrow portions of the corresponding pair of registering T-slots 8, such that each water closet mount bolt 21 is retained in the corresponding pair of aligned T-slots 8 in upwardly-extending configuration. A conventional wax ring or gasket (not illustrated) is placed on top of the assembled and mounted two-piece water closet ring 1 as the upwardly-extending threaded shank 23 of each water closet mount bolt 21 is extended through the wax gasket. The water closet base 26 of a water closet 28 (illustrated in phantom in FIG. 5) is then seated on the wax gasket, a washer 25 is placed over each water closet mount bolt 21 on the water closet base 26 and a nut 24 is threaded on each threaded shank 23 and tightened to snugly engage the washer 25 and compress the wax gasket to firmly and sealingly seat the water closet base 26 on the two-piece water closet ring 1 in conventional fashion.

The first ring segment 2 or second ring segment 10 of the two-piece water closet ring 1 can be individually and selectively removed from the floor 20 and closet drain pipe 15 and replaced due to rusting, corrosion and/or breaking of the first ring segment 2 or second ring segment 10, without having to remove the drain pipe extension 18 from the floor drain pipe. To achieve this end, each of the nuts 24 is unthreaded from the threaded shank 23 of the companion water closet mount bolt 21, the water closet 28 is lifted from the wax gasket and the wax gasket is removed from the water closet mount bolts 21. After the water closet 28 is lifted clear of the water closet mount bolts 21, the ring mount screws 22 are unthreaded from the floor 20 or screw anchors 22*a* and removed from the respective ring mount openings 7 in the selected first ring segment 2 or second ring segment 10, or both, to be replaced. The damaged first ring segment 2 and/or second ring segment 10 is then quickly and easily removed from the drain fitting flange 16 of the closet drain fitting 15. A replacement second ring segment 10 and/or first ring segment 2 is then fitted with a pair of water closet mount bolts 21 as described above and is mounted in engagement with the drain fitting flange 16, with the first segment mount flange 5 and/or second segment mount flange 13 first inserted in the drain pipe flange groove 17. The ring mount screws 22 are then again extended through the respective ring mount openings 7 and threaded into the floor 20 or the screw anchors 22*a*, with the water closet mount bolts 21 extended upwardly through the wax gasket and the water closet base 26, as the water closet 28 is replaced on the wax gasket. A nut 24 is finally threaded on each water closet mount bolt 21 and tightened against a corresponding washer 25, as described above.

It will be appreciated by those skilled in the art that the two-piece water closet ring of this invention is characterized by labor-saving convenience, in that one or both ring elements may be replaced in any water closet installation without disturbing the closet drain fitting which must otherwise be removed and replaced when mounted in place on a sewerage drain pipe by means of a conventional water closet ring. This innovation saves time, money and labor and greatly optimizes water closet drain maintenance. Furthermore, because of the respective T-slots 8 are provided in the end segments of the first ring segment 2 and the second ring segment 10, the channel-shaped ring segments can be installed with coplanar first segment body flanges 6*a* and second segment body flanges 14*a*.

While the preferred embodiments of the invention have been described above, it will recognized and understood that various modifications may be made in the invention and the appended claims are intended to cover all such modifications which may fall within the spirit and scope of the invention.

Having described my invention with the particularity set forth above, what is claimed is:

1. A two-piece water closet ring for seating a water closet on a floor in fluid communication with a drain fitting terminating above the floor in a circular pipe flange, said two-piece water closet ring comprising a substantially semicircular, generally channel-shaped first ring segment for engaging the pipe flange; a first segment raised flange terminating one end of said first ring segment and a first segment straight flange terminating the other end of said first ring segment; a first aperture provided in said first segment raised flange and a second aperture provided in said first segment straight flange; a substantially semicircular, generally channel-shaped second ring segment for engaging the pipe flange; a second segment raised flange terminating one end of said second ring segment and a second segment straight flange terminating the other end of said second ring segment; a third aperture provided in said second segment straight flange for positioning in underlying registering relationship with said first aperture in said first segment raised flange; a fourth aperture provided in said second segment raised flange for positioning in overlying registering relationship with said second aperture in said first segment straight flange; a pair of water closet mount bolts for extension through said third aperture and said first aperture and said fourth aperture and said second aperture, respectively, and engaging said first ring segment and said second ring segment respectively, said water closet mount bolts extending through the base of the water closet; and mounting means for engaging said first ring segment and said second ring segment and the floor and removably mounting said first ring segment and said second ring segment on the floor.

2. The two-piece water closet ring of claim 1 wherein the pipe flange of the drain fitting includes an annular flange groove and further comprising a first segment mount flange formed on said first ring segment between said first segment raised flange and said first segment straight flange, said first segment mount flange adapted for insertion in the flange groove and a second segment mount flange formed on said second ring segment between said second segment raised flange and said second segment straight flange, said second segment mount flange adapted for insertion in the flange groove.

3. The two-piece water closet ring of claim 1 wherein said first aperture comprises a first T-slot, said second aperture comprises a second T-slot, said third aperture comprises a third T-slot and said fourth aperture comprises a fourth T-slot, for receiving and engaging said water closet mount bolts, respectively.

4. The two-piece water closet ring of claim 3 wherein the pipe flange of the drain fitting includes an annular flange groove and further comprising a first segment mount flange formed on said first ring segment between said first segment raised flange and said first segment straight flange, said first segment mount flange adapted for insertion in the flange groove and a second segment mount flange formed on said second ring segment between said second segment raised flange and said second segment straight flange, said second segment mount flange adapted for insertion in the flange groove; and wherein said water closet mount bolts comprise a first headed mount bolt for extension upwardly through said first T-slot, said third T-slot, and the base of the water closet and a second headed mount bolt for extension upwardly through said second T-slot, said fourth T-slot and the base of the water closet and comprising a first washer for positioning on said first headed mount bolt, a first nut for threading on said first headed mount bolt against said first washer, a second washer for positioning on said second headed mount bolt and a second nut for threading on said second headed mount bolt against said second washer.

5. The two-piece water closet ring of claim 1 wherein said mounting means comprises at least one ring mount opening provided in said first ring segment and said second ring segment, respectively, and at least one ring mount screw for extension through said at least one ring mount opening, respectively, and engaging the floor.

6. The two-piece water closet ring of claim 5 wherein the pipe flange of the drain fitting includes an annular flange groove and further comprising a first segment mount flange formed on said first ring segment between said first segment raised flange and said first segment straight flange, said first segment mount flange adapted for insertion in the flange groove and a second segment mount flange formed on said second ring segment between said second segment raised flange and said second segment straight flange, said second segment mount flange adapted for insertion in the flange groove.

7. The two-piece water closet ring of claim 6 wherein said first aperture comprises a first T-slot, said second aperture comprises a second T-slot, said third aperture comprises a third T-slot, and said fourth aperture comprises a fourth T-slot, for receiving said water closet mount bolts, respectively.

8. A two-piece water closet ring for mounting on a floor and supporting, by means of a first water closet mount bolt and a second water closet mount bolt, a water closet having a base in fluid communication with a water closet drain fitting extending upwardly through the floor from a floor drain, said water closet ring comprising a substantially semicircular, generally channel-shaped first ring segment having curved, substantially parallel first body flanges for engaging the floor and a first segment mount flange for engaging the water closet drain fitting; a first segment raised flange provided in one end of said first ring segment and a first segment straight flange provided in the other end of said first ring segment; a first T-slot provided in said first segment raised flange and a second T-slot provided in said first segment straight flange; at least one first segment ring mount opening disposed between said first T-slot and said second T-slot in said first ring segment; a first segment ring mount screw for extension through said first segment ring mount opening and threading into the floor; a substantially semicircular, generally channel-shaped second ring segment having substantially parallel second body flanges for engaging the floor and a second segment mount flange for engaging the water closet drain fitting, said second ring segment having a second segment raised flange provided in one end of said second ring segment and a second segment straight flange provided in the other end of said second ring segment; a third T-slot provided in said second segment straight flange for positioning in underlying and registering relationship with said first T-slot in said first segment raised flange of said first ring segment; a fourth T-slot provided in said second segment raised flange for positioning in overlapping, registering relationship with said second T-slot in said first segment straight flange of said first ring segment; at least one second segment ring mount opening disposed between said second segment raised flange and said second segment straight flange; a second segment ring mount screw for extension through said second segment ring mount opening and threading into the floor; said first T-slot and said third T-slot adapted to receive said first water closet mount bolt for extension upwardly through said first T-slot and said third T-slot and the base of the water closet and a first nut for threading on said first water closet mount bolt; and said second T-slot and said fourth T-slot adapted to receive said second water closet mount bolt for extension upwardly through said second T-slot and said fourth T-slot and the base of the water closet and a second nut for threading on said second water closet mount bolt, and whereby the water closet is removably mountable on the two-piece water closet ring.

9. The two-piece water closet ring of claim 8 wherein said first ring segment and said second ring segment are constructed of stamped steel plate.

10. The two-piece water closet ring of claim 8 wherein the water closet drain fitting includes a circular flange groove and wherein said first segment mount flange formed on said first ring segment between said first segment raised flange and said first segment straight flange engages the flange groove and said second segment mount flange formed on said second ring segment between said second segment raised flange and said second segment straight flange engages the flange groove.

11. A two-piece water closet ring for mounting on a floor and supporting a water closet having a base in fluid communication with a water closet drain fitting extending upwardly through the floor from a drain pipe and having a circular flange groove, said water closet ring comprising a substantially semicircular, generally channel-shaped, metal first ring segment having curved, substantially parallel and coplanar first segment body flanges for engaging the floor; a semicircular first segment mount flange for engaging the flange groove of the water closet drain fitting; a first segment raised flange provided in one end of said first ring segment and a first segment straight flange provided in the other end of said first ring segment; a first T-slot provided in said first segment raised flange and a second T-slot provided in said first segment straight flange; a plurality of first segment ring mount openings disposed between said first segment raised flange and said first segment straight flange; first segment ring mount screws for extension through said first segment ring mount openings and threading into the floor; a substantially semicircular, generally channel-shaped, metal second ring segment having curved, substantially parallel and coplanar second segment body flanges for engaging the floor; a semicircular second segment mount flange for engaging the flange groove of the water closet drain fitting adjacent to said first segment mount flange, said second ring segment having a second segment raised flange provided in one end of said second ring segment and a second segment straight flange provided in the other end of said second ring segment; a third T-slot provided in said second segment straight flange for positioning in underlying registering relationship with respect to said first T-slot in said first segment raised flange of said first ring segment; a fourth T-slot provided in said second segment raised flange, said fourth T-slot positioned in overlapping, registering relationship with respect to said second T-slot in said first segment straight flange of said first ring segment; a plurality of second segment ring mount openings disposed between said third T-slot and said fourth T-slot; second segment ring mount screws for extension through said second segment mount openings and threading into the floor; a first water closet mount bolt for extension upwardly through said first T-slot and said third T-slot and the base of the water closet and a first washer and nut for positioning on said first water closet mount bolt; and a second water closet mount bolt for extension upwardly through said second T-slot and said fourth T-slot and the base of the water closet and a second washer and nut for positioning on said second water closet mount bolt and removably mounting the water closet on said two-piece water closet ring.

* * * * *